US007651005B2

(12) United States Patent
Nguyen et al.

(10) Patent No.: US 7,651,005 B2
(45) Date of Patent: Jan. 26, 2010

(54) EDUCATIONAL DRINKING DEVICE

(75) Inventors: William Hung Nguyen, Apple Valley, MN (US); Dien Dong Bui, Menasha, WI (US); Davis Dang Hoang Nhan, Appleton, WI (US); Peiguang Zhou, Appleton, WI (US)

(73) Assignee: 2N Corporation, Appleton, WI (US)

( * ) Notice: Subject to any disclaimer, the term of this patent is extended or adjusted under 35 U.S.C. 154(b) by 0 days.

(21) Appl. No.: 11/726,443

(22) Filed: Mar. 22, 2007

(65) Prior Publication Data

US 2007/0163984 A1 Jul. 19, 2007

Related U.S. Application Data

(63) Continuation-in-part of application No. 11/060,820, filed on Feb. 18, 2005, now Pat. No. 7,303,086.

(51) Int. Cl.
*A61J 9/00* (2006.01)
*A47G 19/22* (2006.01)

(52) U.S. Cl. ..... 215/365; 215/11.1; 215/11.3; 215/11.6; 215/396; 220/703; 220/711; 220/738

(58) Field of Classification Search ..... 215/11.1, 215/276, 396, 10, 11.3, 11.6, 365; 220/717, 220/62.12, 703, 711, 737, 738; 229/400, 229/906.1; D7/314; 434/171, 433; 206/459.1
See application file for complete search history.

(56) References Cited

U.S. PATENT DOCUMENTS 1,250,053 A * 12/1917 Weaver ..... 43/42.72
1,250,058 A * 12/1917 Weaver ..... 215/276
D138,727 S * 9/1944 Gilvar ..... D7/514
2,926,805 A * 3/1960 Mead ..... 215/11.1
3,574,957 A * 4/1971 Bello-Bridick ..... 434/173
4,789,073 A * 12/1988 Fine ..... 215/13.1
5,040,719 A * 8/1991 Ballway ..... 220/738
5,069,351 A * 12/1991 Gunderson et al. ..... 215/11.1
5,191,979 A * 3/1993 Nemeroff ..... 206/459.5
5,400,907 A * 3/1995 Chen ..... 206/459.1
5,492,077 A * 2/1996 Rose ..... 116/307
D377,737 S * 2/1997 Kristnik ..... D7/511
6,164,469 A * 12/2000 Sartore ..... 215/12.1
D450,535 S * 11/2001 McDonough et al. ..... D7/510
D452,116 S * 12/2001 McDonough et al. ..... D7/510
D477,500 S * 7/2003 Smith ..... D7/515
6,631,819 B1 * 10/2003 Diak/Ghanem ..... 215/11.1
6,719,451 B1 * 4/2004 Yue ..... 366/130
6,722,513 B1 * 4/2004 Flood et al. ..... 215/11.1
6,881,066 B1 * 4/2005 Sarconi ..... 434/174
7,083,103 B2 * 8/2006 Hull ..... 235/487
2003/0076673 A1 * 4/2003 Diak/Ghanem ..... 362/101
2003/0192891 A1 * 10/2003 Ziegler ..... 220/288
2003/0234235 A1 * 12/2003 Renz ..... 215/11.1
2004/0060212 A1 * 4/2004 Murphy et al. ..... 40/324
2004/0060840 A1 * 4/2004 Williams et al. ..... 206/459.5
2005/0242103 A1 * 11/2005 Thomas et al. ..... 220/717

* cited by examiner

*Primary Examiner*—Sue A Weaver
(74) *Attorney, Agent, or Firm*—Brendan C. Babcock; Babcock Legal Services PLLC

(57) ABSTRACT

The present invention provides a disposable educational drinking device for learning such things as the letters of the alphabet or numbers or geometric shapes. The disposable drinking device can be converted to a reusable drinking device. The disposable drinking device also has a mechanical mean to center drinking spout between handles.

18 Claims, 16 Drawing Sheets

EDUCATIONAL DRINKING DEVICE

This application is a continuation-in-part of U.S. patent application Ser. No. 11/060,820 filed Feb. 18, 2005 now U.S. Pat. No. 7,303,986, and entitled "Disposable containers for prepare, storage and serving infant formula". The entirety of application Ser. No. 11/060,820 is hereby incorporated by reference.

FIELD OF THE INVENTION

The present invention relates to infant and toddler feeding and storing system. More particularly, the present invention relates to disposable drinking devices and nursing assemblies that can be used for preparing, storing and serving liquid food or perishable beverages such as juice, breast milk and infant formula.

The present invention also relates to a disposable educational drinking device displaying symbols, and to a disposable drinking device having changeable displayed symbols suitable for use by children.

The present invention also relates to a drinking device that can be used either as a disposable drinking device or as a reusable drinking device. Both are suitable for use by children.

BACKGROUND OF THE INVENTION

Infants are required to be fed very frequently with a small amount of milk such as breast milk or infant formula, and therefore many clean bottles shall be needed. In order to minimize a chance that a baby can be infected by bacteria, the bottle is often washed and sterilized with boiling water or steam before it is again used. Such activities of washing and sterilizing bottles are extra work for parents who are already tired and do not have enough sleep. Therefore, it would be advantageous to have a bottle or drinking device that is pre-sterilized before use and can be disposed after use.

Similarly, young children like to drink beverages or milk frequently during the day. Thus, multiple clean drinking devices, such as those commonly known as "sippy cups", shall be needed during a course of a day. When a family with young children is on a road trip, it is not convenient and sanitary to wash their children's sippy cups at public rest rooms or at rest areas. Therefore, there is a need in the art for a disposable drinking device to provide convenience and cleanliness and to free the parents from washing. Furthermore, it would be even more convenient if a disposable drinking device can be easily converted to a reusable drinking device whenever the parents wish to do so. This would eliminate the need for the parent to buy refill containers/lids right away after they run out of disposable containers/lids as the young children can use a reusable drinking device instead.

Therefore, it is desirable to provide a drinking device that can be easily and conveniently used as either a disposable drinking device or a reusable drinking device. Further, there is a need in the art to make a disposable drinking device affordable.

It is widely acknowledged that young children can learn at early age before they can express themselves. Learning can be dramatically enhanced when a child is visually and repeatedly exposed to alphanumeric characters, such as the letters of the alphabet and numbers. The alphabet and numbers are the basis for a child's development of reading and math skills in later years. Learning apparatus and toys to assist in teaching the letters of the alphabet and numbers have always been of great interest. For example, cubes or blocks with letters and numbers on the various sides thereof, are toys with learning emphasis.

Traditionally, spill-resistant drinking devices for children are typically used to help a child develop the fine motor skills needed to drink from a cup without spilling. At present, sippy cups have not been utilized as a tool to provide any other kind of learning other than being a feeding or drinking tool for children. Of course, commercial available sippy cups have various popular cartoon characters printed on the cups. Popular cartoon characters are only meant to increase a child's desire for the cups and to persuade a purchase decision if a particular cartoon character on the cups is a child's beloved character. The cartoon characters alone are not intended and do not provide learning of any kind to a child.

Traditionally, paper cup or plastic cup for holding hot or cold beverages has not been utilized as a tool to provide learning of any kind. Of course, commercial available paper and plastic cups may have various prints or logos on them. These prints or logos are meant for advertisement or for brand identification or for visual interest. Prints or logos alone are not intended and do not provide learning of any kind.

Therefore, it would be desirable to provide a disposable drinking device with a learning arrangement that may be different from sippy cup to sippy cup. The present invention uses a repetitive visual stimulation technique by displaying changeable symbols on a disposable sippy cup, which provides a convenient, fun and attractive mean for early childhood learning.

SUMMARY OF THE INVENTION

In at least one embodiment of the present invention a disposable educational drinking device is provided which can be used to provide a learning arrangement to assist in the learning of the letters of the alphabet, numbers, geometric shapes, etc. by visually and repeatedly exposing the letters, the numbers, the geometric shapes, etc to children who are using the device. T Throughout this application the term "learning arrangement" includes any plurality of characters, words, images, and/or symbols having a sequence, a progression, and/or a grouping of related items, actions, or concepts. Examples of such learning arrangements are letters of the alphabet and progressions of those letters; numeric progressions such as counting; numeric sequences; grouping of different shapes, seasons, animals, plants, and/or astronomic/atmospheric bodies; and/or grouping of similar shapes, seasons, animals, plants, and/or astronomic/atmospheric bodies (in some embodiments also in a numeric progression). Other learning arrangements include grouping actions such as running, walking, or sitting or concepts such as how a wheel makes moving something easier. These examples are only given for illustrative purposes and by no means provide an exhaustive listing.

It is an object of the invention to provide an early childhood teaching tool that is incorporated into a disposable drinking device that will give children a head start in learning basic skills necessary for success in school and life.

It is another object of the invention to hold a child's attention and interest with meaningful and colorful symbols, numbers, geometric shapes, words, etc while the child is using a disposable drinking device.

It is another object of the present invention to provide bonding between a child and his or her parents as the parents point out or teach the letters of the alphabet, numerals, geometric shapes, etc on a disposable drinking device.

It is another objective of the present invention to provide a drinking device that can be easily and conveniently converted between a disposable drinking device and a reusable drinking device.

It is another object of the present invention to provide a disposable drinking device containing a mechanical interlock mean to center the drinking spout in between the two handles on the locking ring.

The above objectives and advantages of the present invention are provided by a drinking device that is convertible between disposable and reusable applications. The disposable configuration comprises a disposable container, a disposable lid having a base portion with a drinking spout extending therefrom, a holder and a locking ring. The reusable configuration comprises a cup and a locking cap.

The above discussed and other features and advantages of the present invention will be appreciated and understood by those skilled in the art from the following detailed description and drawings.

DEFINITIONS

Within the context of this specification, each term or phrase below includes the following meaning or meanings:

"Disposable" refers to articles which are designed to be discarded after a limited use rather than being cleaned or otherwise restored for reuse.

"Reuse" or "reusable" refers to articles which are not designed to be disposable.

"Alphanumeric" refers to letters of the alphabet and numbers.

"Symbols" refer to letters of the alphabet, numbers, geometrical shapes, characters, concepts, images, words, and objects.

These terms may be defined with additional language in the remaining portions of the specification.

DETAILED DESCRIPTION OF THE INVENTION

The present invention is related to a disposable educational drinking device for teaching children the letters of the alphabet, numbers, geometric shapes, etc. In at least one embodiment, the drinking device would be utilized by children, with the help of their parents, to familiarize with the letters of the alphabet, numbers, geometric shapes, etc.

Figure 1:
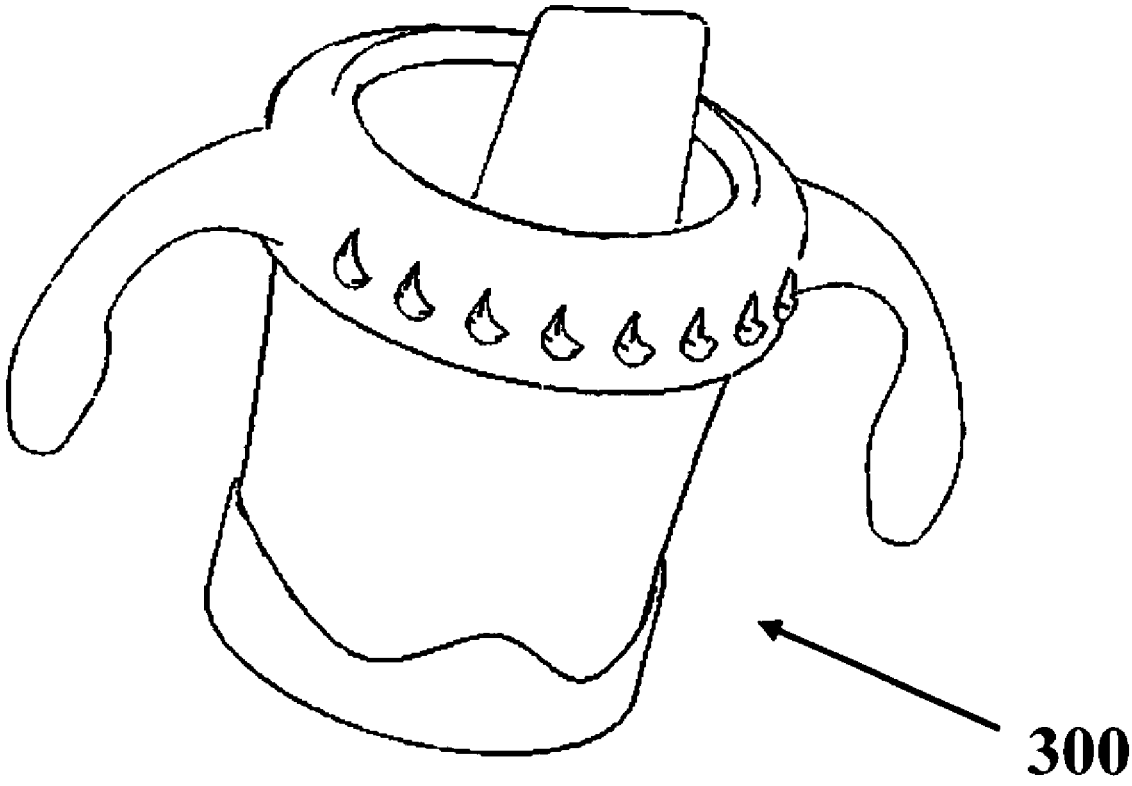
FIG. 1 representatively illustrates a plan view of the educational disposable drinking device of the present invention.
Figure 2:
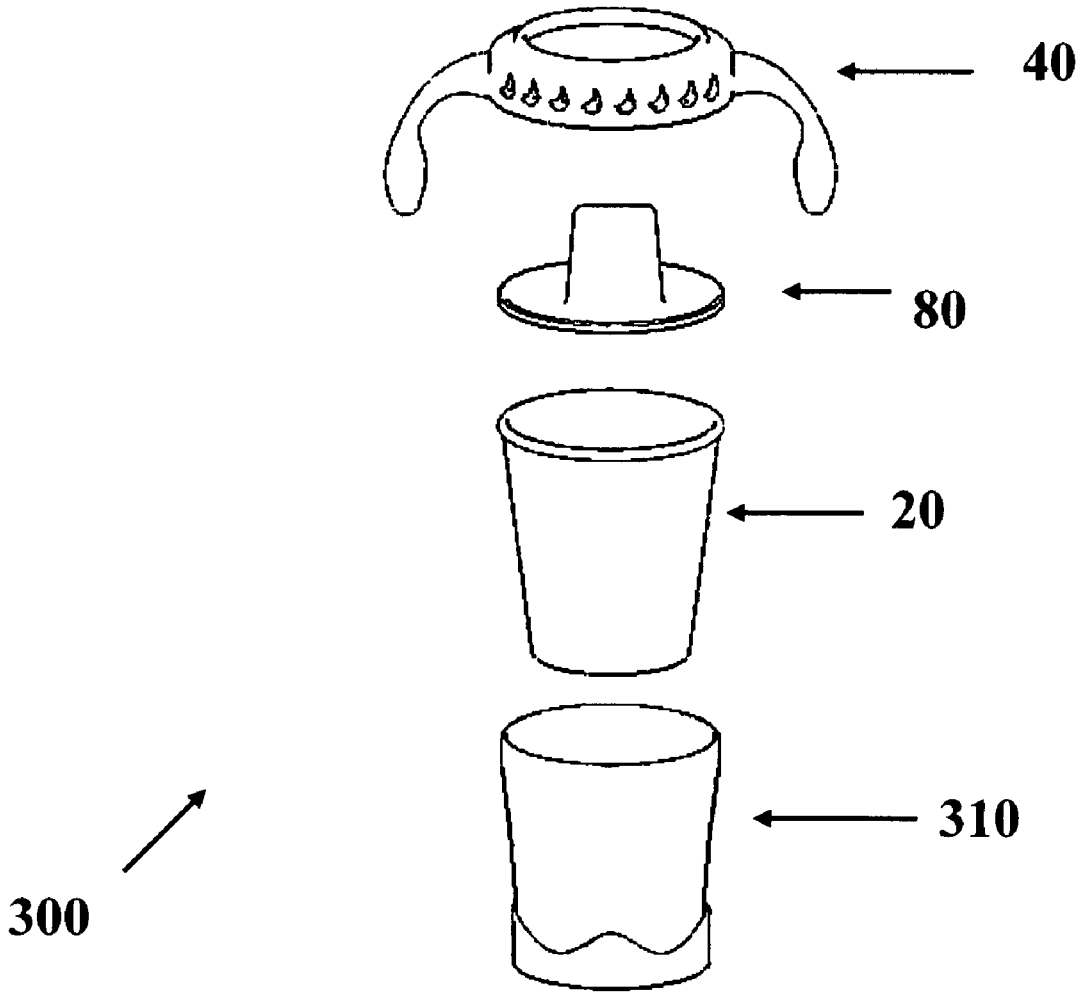
FIG. 2 representatively illustrates an exploded view of the components of the educational disposable drinking device of FIG. 1.

The disposable drinking device 300 of the present invention shown in FIG. 1 and FIG. 2 generally contains a holder 310, a disposable container 20, a locking ring 40 and a disposable lid 80.

The disposable container 20 shown in FIG. 3 has a cylindrical or truncated cone shape (hereinafter these terms will be referred to as "cylindrically shaped"), having a container body 24, an opening end 29, a closed end 26, and a flange 22. The container 20 has preferably larger opening end and smaller closed end to allow stacking of multiple containers 20 for packaging.

The open end 29 of the disposable container is defined by the flange 22 which is preferably circular in shape. The open end 29 is defined by the flange 22, which is extended outward from the container body 24 and along the entire circumference of the container body 24.

Figure 17:
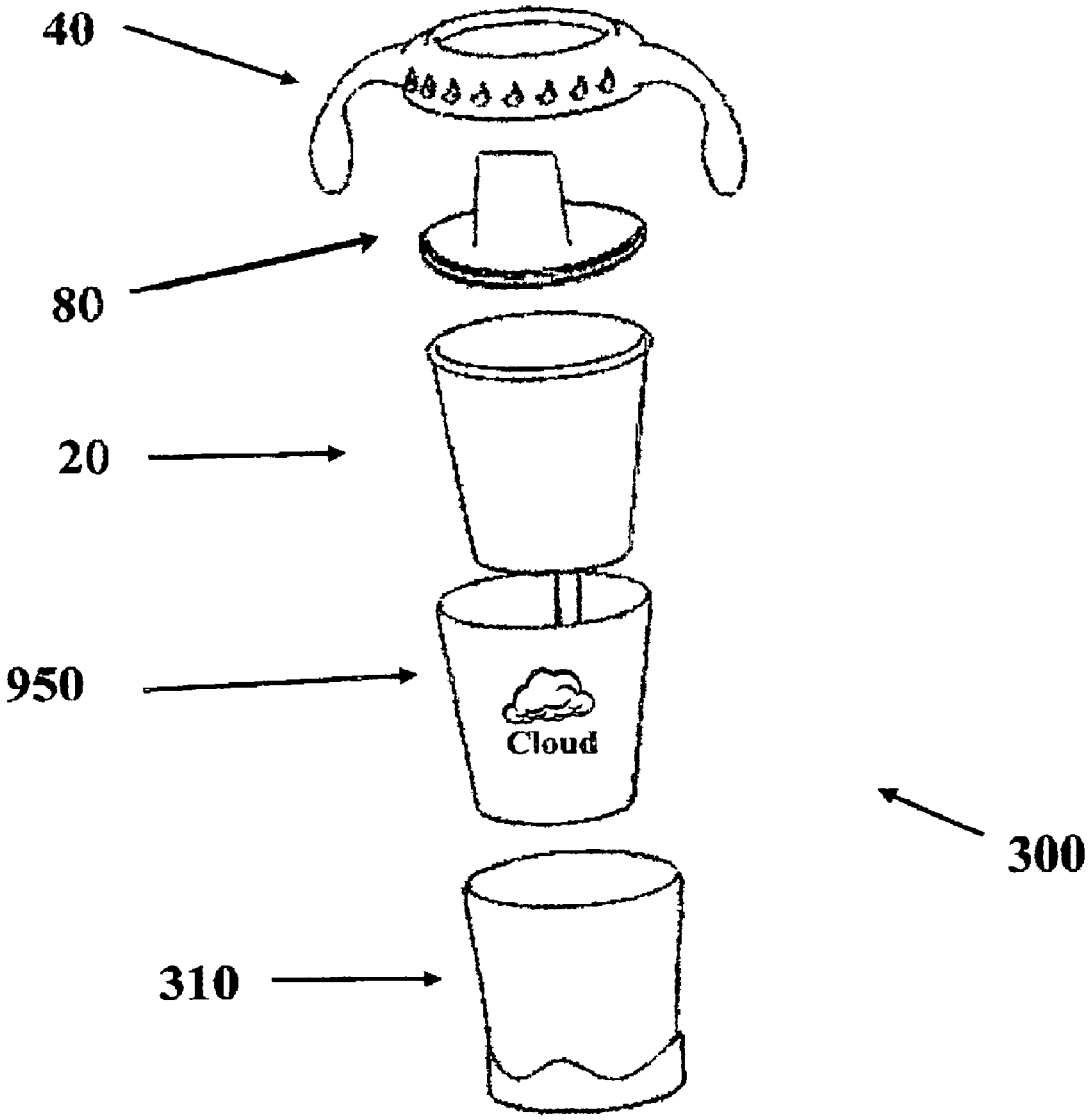
FIG. 17 representatively illustrates an exploded view of the components of an embodied drinking device.

In at least one embodiment of the invention, symbols can be printed on the outer surface of the container body 24 of the disposable container 20. In an alternative embodiment of the invention, as shown in FIG. 17, the symbols can be printed on a separate sheet 950 or piece of paper, cardboard or plastic 950 which can be then attached, adhered to or wrapped around the outside of the container body 24 before the container 20 is put into the holder 310.

The flange 22, the container body 24 and the close end 26 are made from a rigid material that is compression-resistant in the axial and/or radial direction. A container that comprises a compression-resistant material does not collapse or change substantially its shape or volume during normal feeding by the user. A compression-resistant container can also withstand boiling water without deforming or distorting the shape of the container. The container can be made from a water-proofed or water-resistant material. The water-proofed material can be plastic or a polymer coated paperboard (i.e., comprised of a wood or cellulose material), which is coated on both side of the paperboard. The paperboard material can be any effective composition, including, e.g. selected kraft, bleached, news, or white-lined recycled or virgin paperboard. Polymers that can be used, include, e.g., polyethylene, polypropylene, polyester, polyethylene terephthalate, polybutylene terephthalate, derivatives thereof, etc. The thickness of the water-proofed or resistant material can be of any effective size, e.g., in some embodiments from 0.1 to 3.0 mm, in some embodiments in a range of 0.2 to 0.7 mm, in some embodiments in a range of 0.3 to 0.5 mm. Other water-proofed or water-resistant material can be used as well, such as wax coated paperboard, polystyrene, foamboard, styrofoam, etc, and other laminate combinations.

Figure 3:
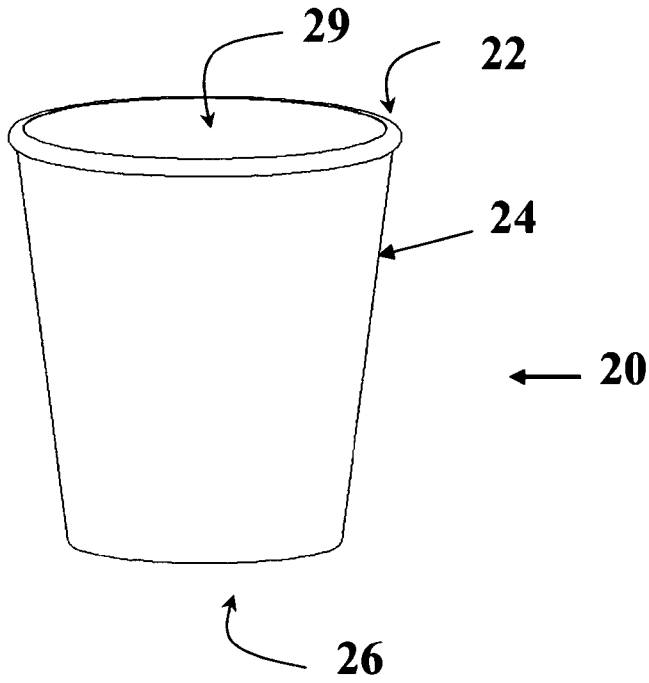
FIG. 3 representatively illustrates a plan view of the disposable container with printed numbers and geometric shapes.
Figure 4:
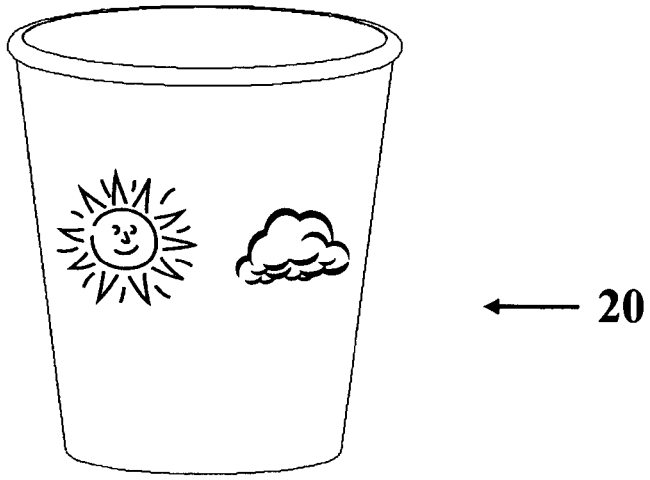
FIG. 4 representatively illustrates a plan view of the disposable container with printed pictures and words.

Referring now to FIG. 3 and FIG. 4, the disposable container 20 contains alphanumeric characters printed on the outer surface of the container body 24. Alphanumeric characters can also be printed on the inner surface (not shown) of the container body 24. The alphanumeric characters may include any letters of the alphabet, numbers, or combination thereof. In an alternative embodiment of the invention, it is contemplated that the disposable container 20 contains any geometric shapes, such as square, triangle, circle, or combination thereof, in addition to the alphanumeric characters. In another alternative embodiment of the invention, it is contemplated that the disposable container 20 contains any pictures such as the animals, plants (flowers), machines (rocket), the sun, etc., in addition to the alphanumeric characters. In a further embodiment of the present invention, the disposable container 20 may include descriptive word(s) to describe pictures of objects. For example, a word "sun" would be printed under a picture of the sun to teach words to young children.

Symbols can be printed on the outer surface or inner surface of the container body 24 using any kind of ink, any ink color, and any printing method known in the arts. In some embodiments, the ink is non-toxic and/or does not dissolve in a liquid. The outer surface of the container body 24 is defined as the side of the container that does not contact a liquid or a beverage that it contains therein. The inner surface of the container body 24 is defined as the side of the container that directly contacts a liquid or a beverage that it contains therein.

Figure 5:
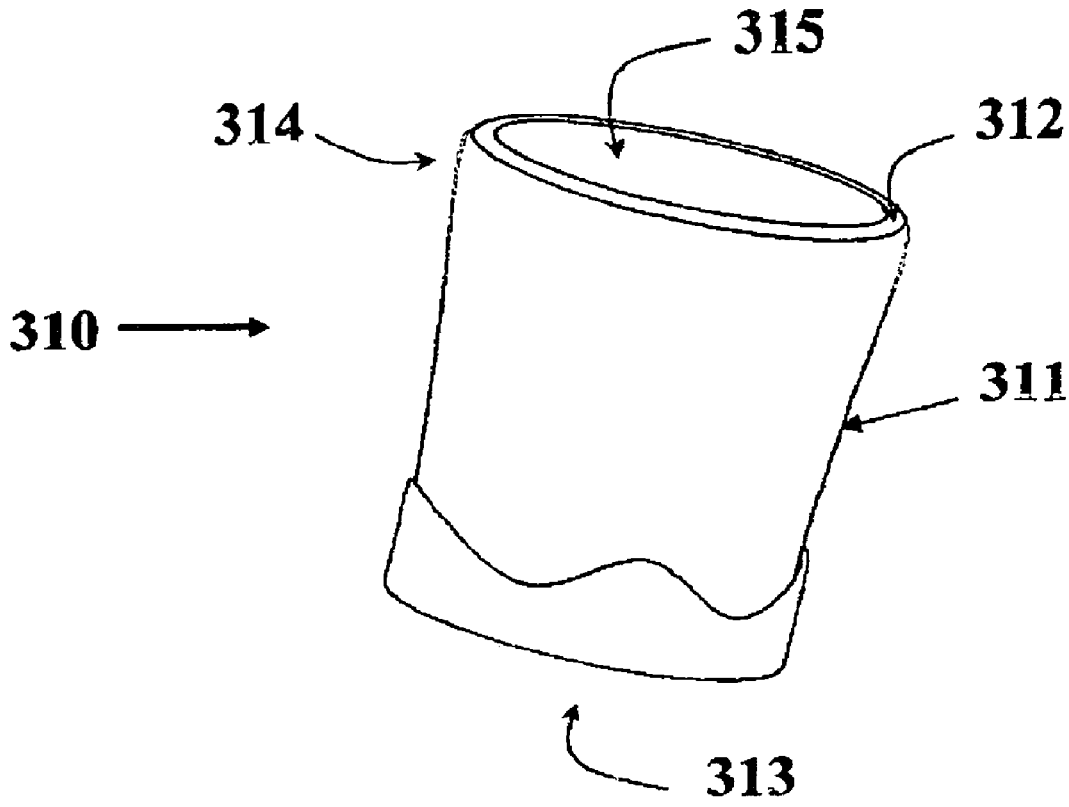
FIG. 5 representatively illustrates a plan view of the holder.

Referring to FIG. 5, holder 310 is cylindrically shaped, having a holder body 311, a bottom closed end 313, a top open end 315 and a rim 312. The top open end has external threads 314. The holder body 311 is long enough to contain the entire disposable container body 24 therein. The rim 312 has an interior circumference that is large enough to receive the disposable container body 24. However, the interior circumference of the rim 312 should be smaller than the outer circumference of the flange 22, which allow the flange 22 to sit on top of the rim 312 when the disposable container 20 is inserted onto the holder 310.

The top open end 315 of the holder 310 is defined by the rim 312 which can be circular in shape. The top open end 315 has external threads 314, which allow engagement of the top open end 315 with the locking ring 40.

In another embodiment, holder 310 has the interior circumference at closed end 313 large enough to receive the disposable container closed end 26.

In at least one embodiment, the holder body 311 is shorter than the disposable container body 24, which allows a gap between the flange 22 and the rim 312 when the disposable container 20 is inserted onto the holder 310.

The holder 310 can be made from a clear (see-through) and rigid polymeric material such as polycarbonate and polyester etc. When the disposable drinking device 300 is assembled, the container 20 is inserted into the holder 310. With a clear body of the holder 310, the printed alphanumeric characters, geometrical shapes, pictures, etc on the outer surface of the container body 24 can be visible and readable through the holder body 311.

Figure 13:
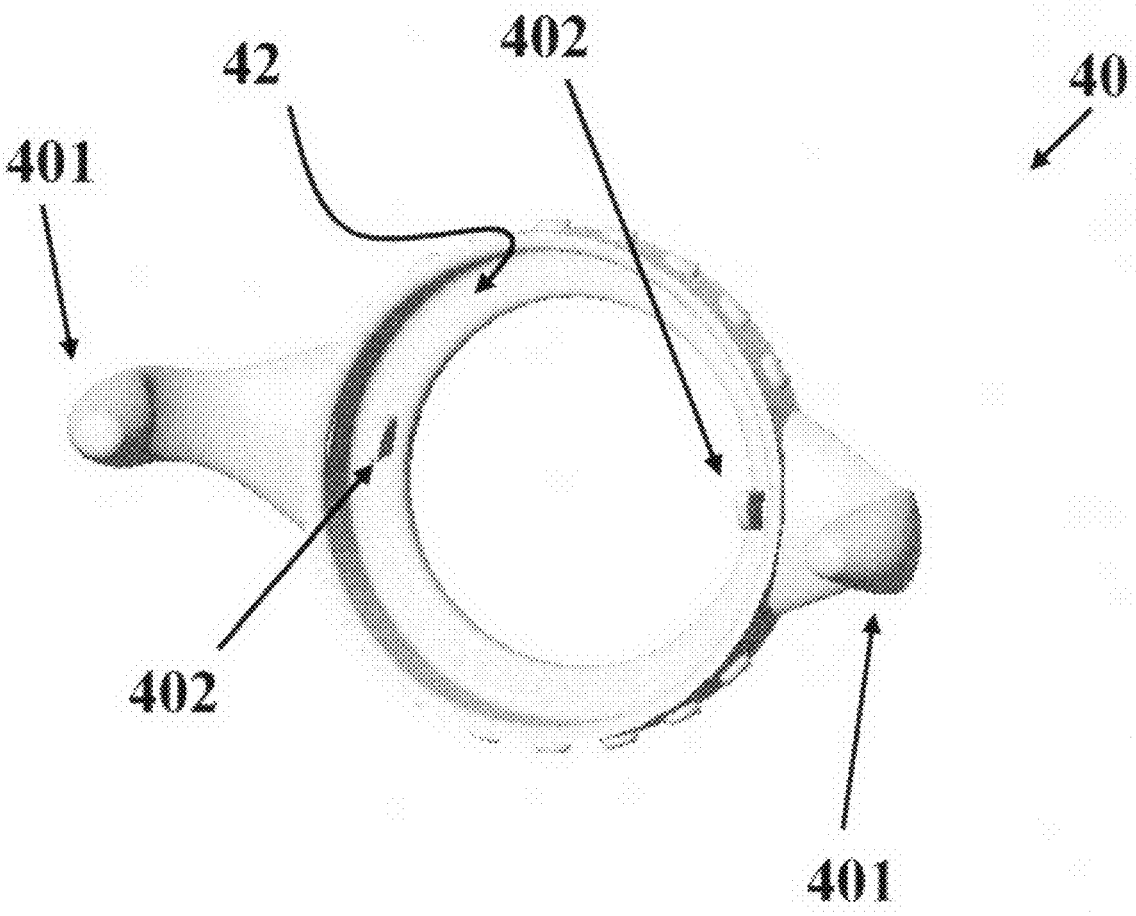
FIG. 13 representatively illustrates a bottom view of the locking ring containing two underlying pins.
Figure 14:
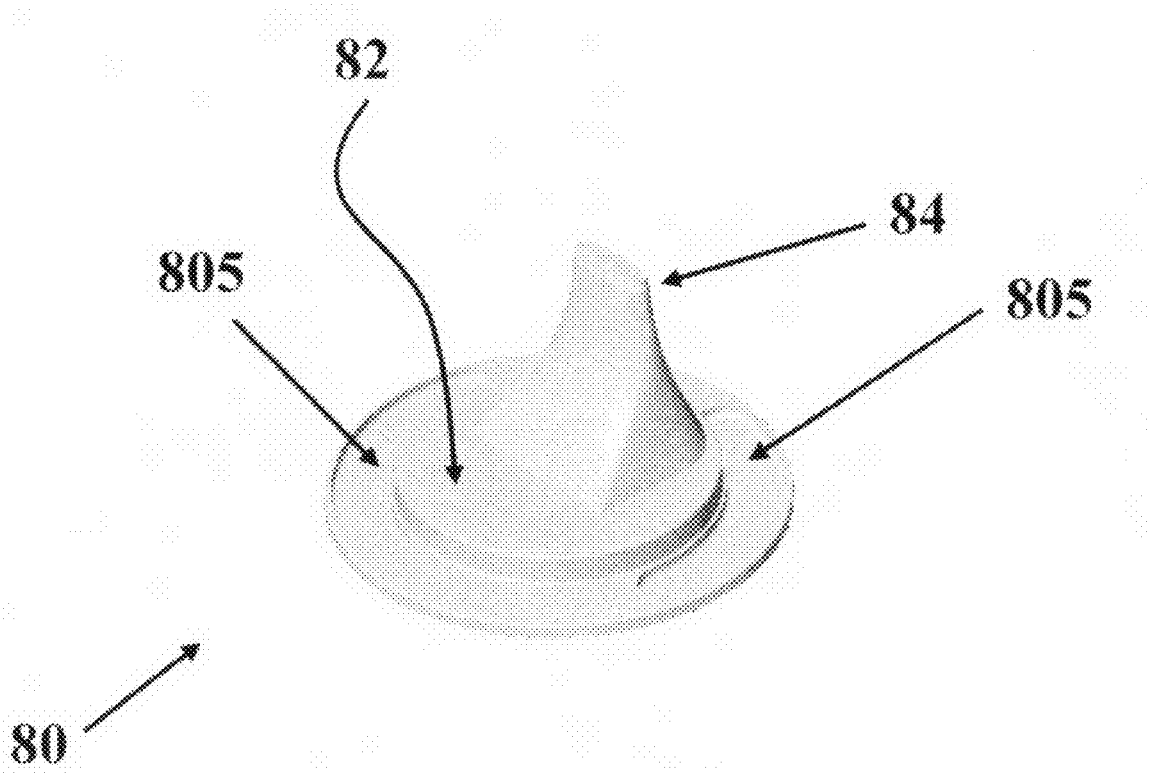
FIG. 14 representatively illustrates a plan view of the lid containing two channels.
Figure 15:
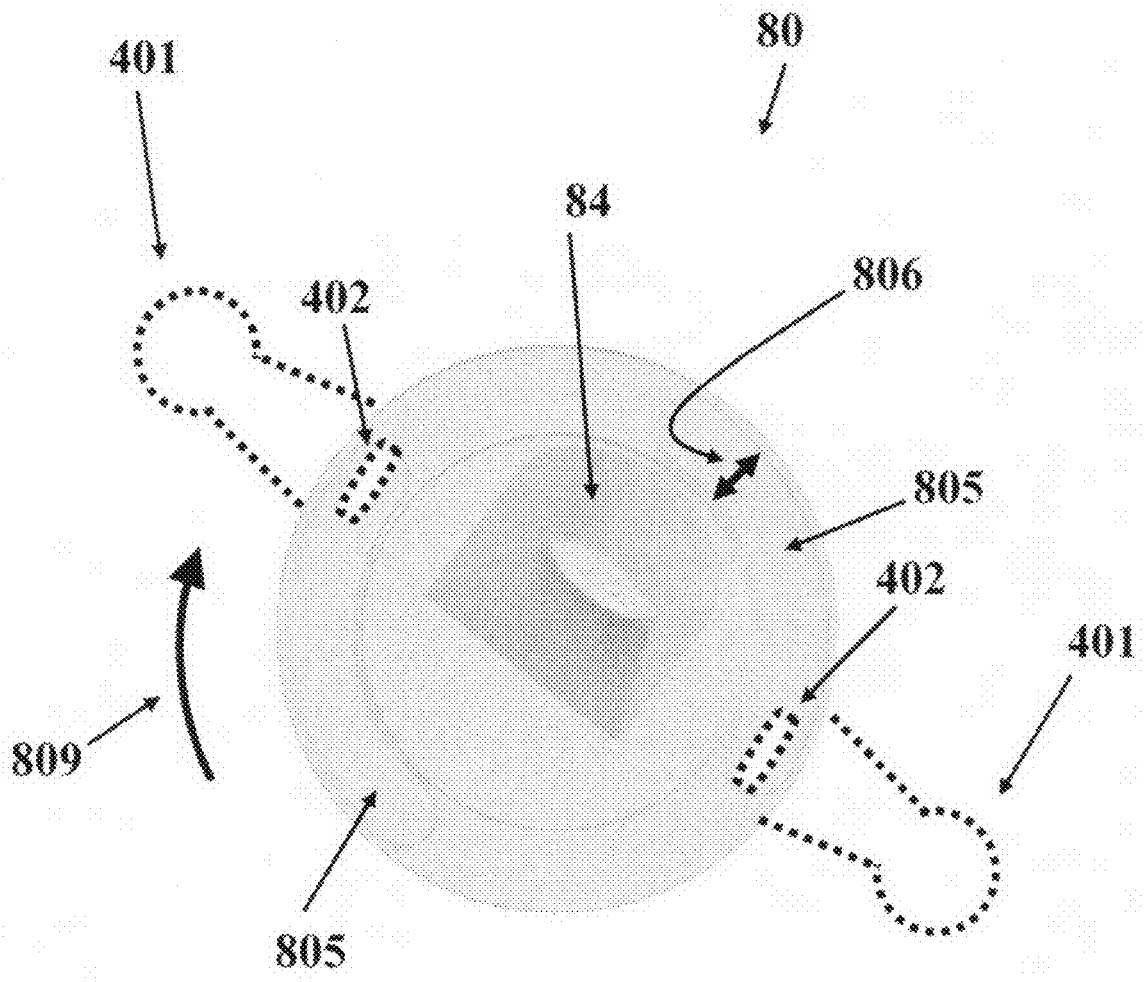
FIG. 15 representatively illustrates a top view of the lid.
Figure 16:
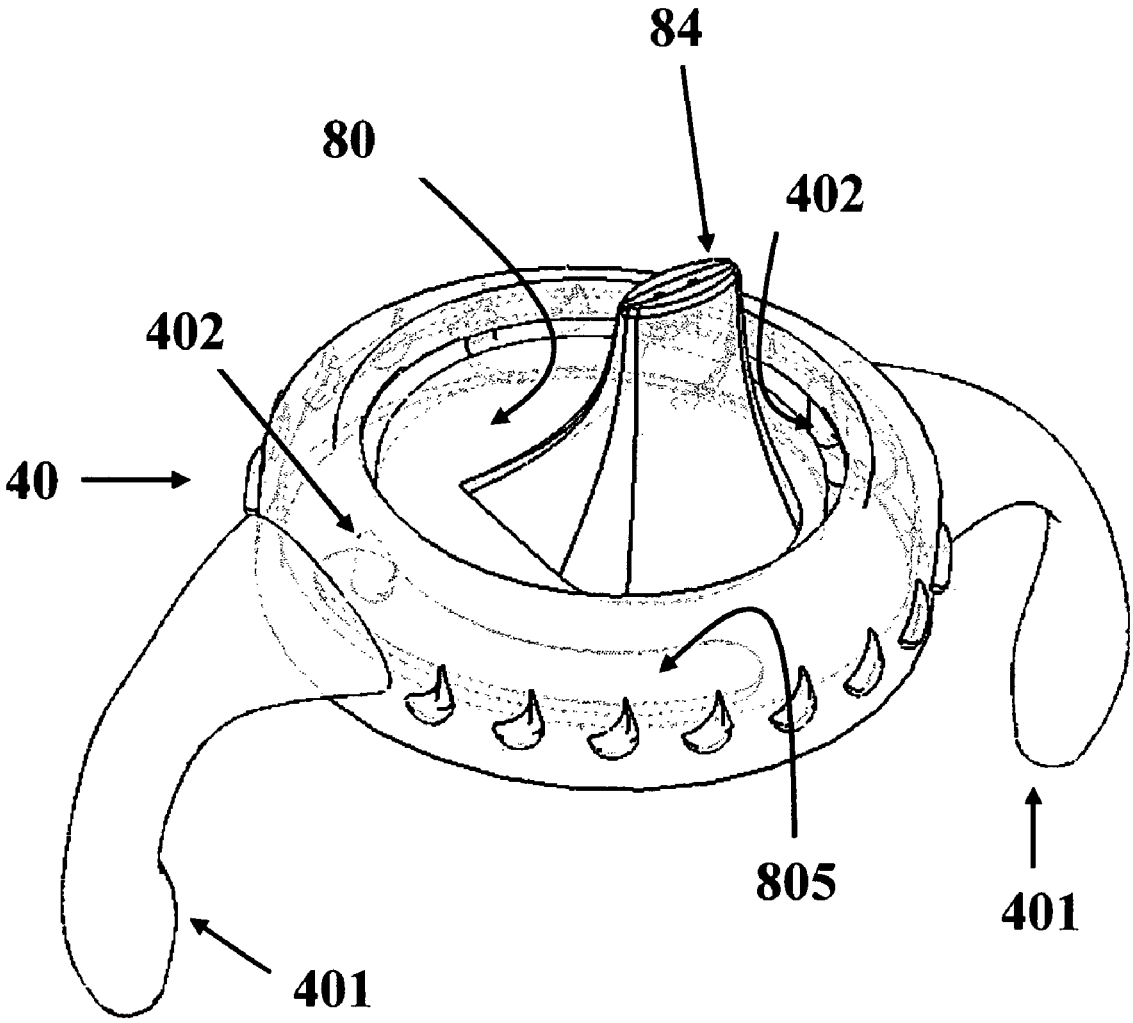
FIG. 16 representatively illustrates a plan view of the locking ring with the lid engaged.

In at least one embodiment of the present invention, a mechanical interlock mean between the lid 80 and the locking ring 40 is provided as shown in FIG. 13, FIG. 14, and FIG. 15.

Figure 6:
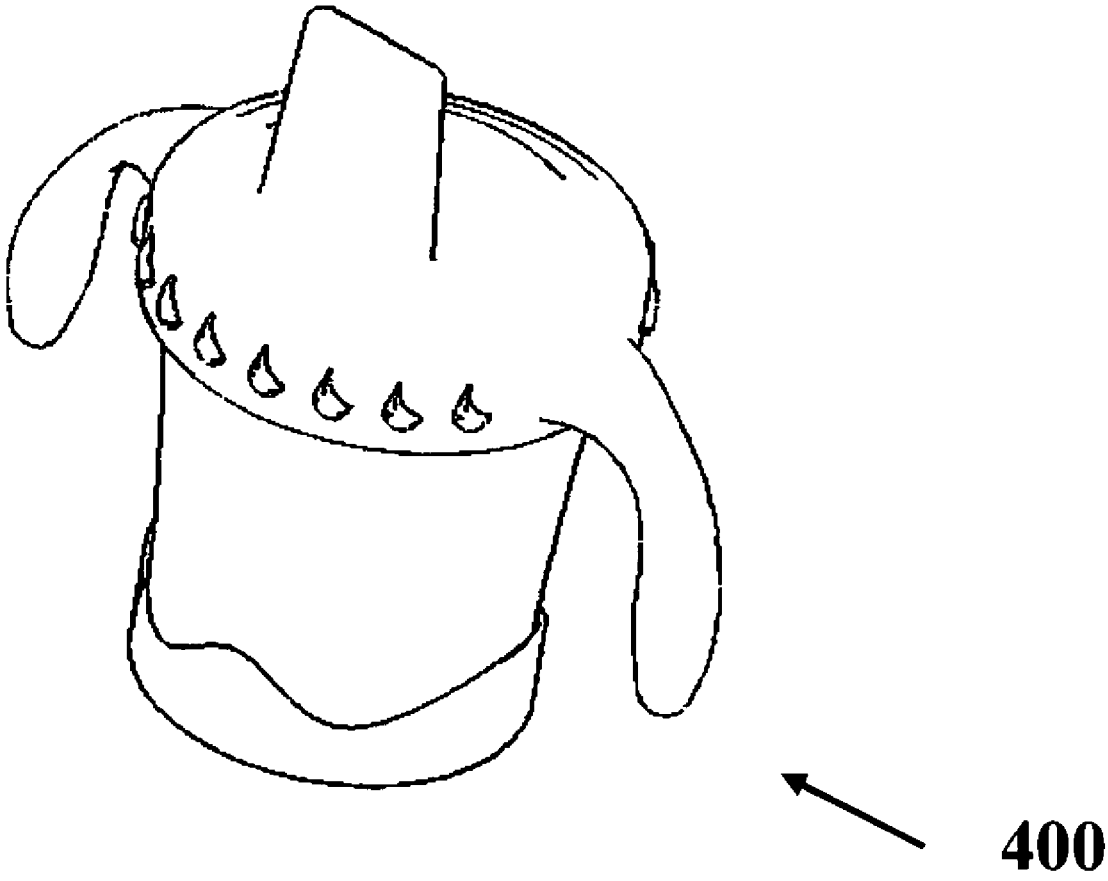
FIG. 6 representatively illustrates a plan view of the non-disposable (reusable) drinking device of the present invention.
Figure 7:
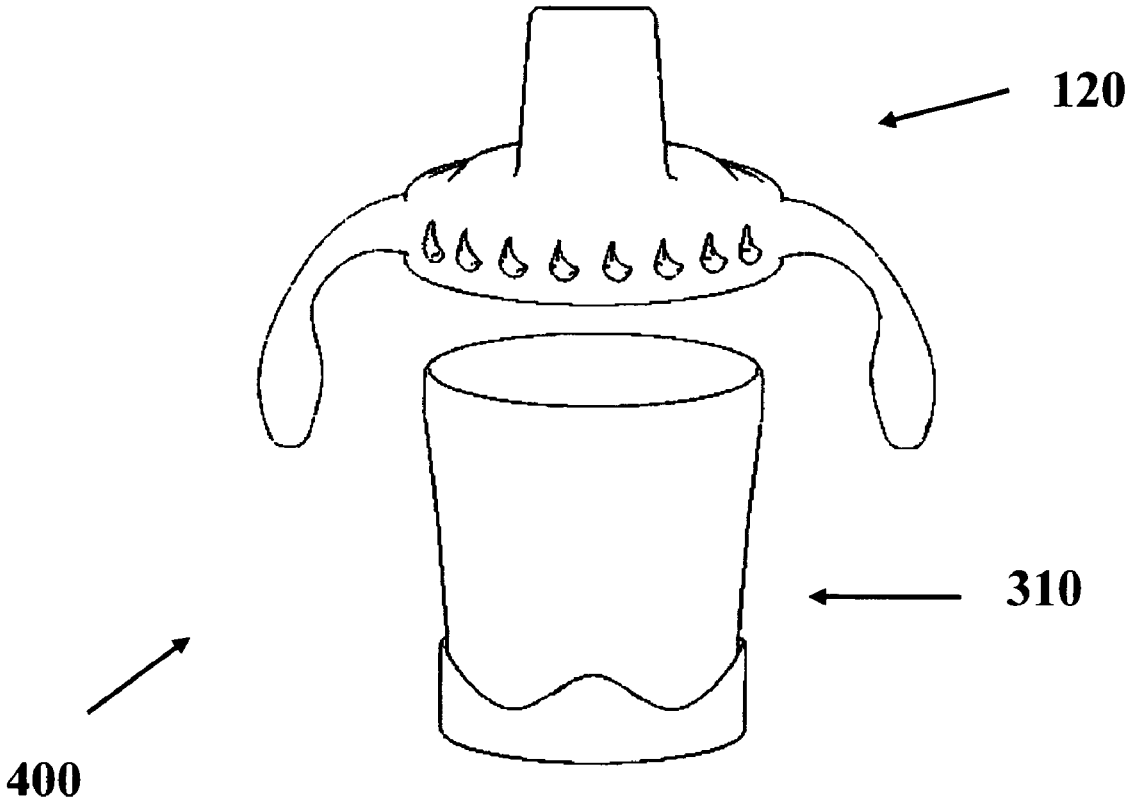
FIG. 7 representatively illustrates an exploded view of the components of the non-disposable (reusable) drinking device of FIG. 6.

In at least one embodiment of the present invention, the educational disposable drinking device 300 can be converted to a conventional sippy cup 400, which is a (non-disposable) reusable sippy cup. Referring now to FIG. 6 and FIG. 7, rather than using a disposable container 20 within the sippy cup 400, the sippy cup comprises a holder 310 and a locking cap 120. In this reusable sippy cup configuration, the holder 310 functions as a cup to hold a beverage. The sippy cup 400 can still accommodate a disposable container 20 as described above by engaging the flange 22 to the rim 312 as shown with FIG. 2 and FIG. 5 or in a variety of other ways, but it also allows for the versatility of using the sippy cup with or without the disposable container 20.

Figure 8:
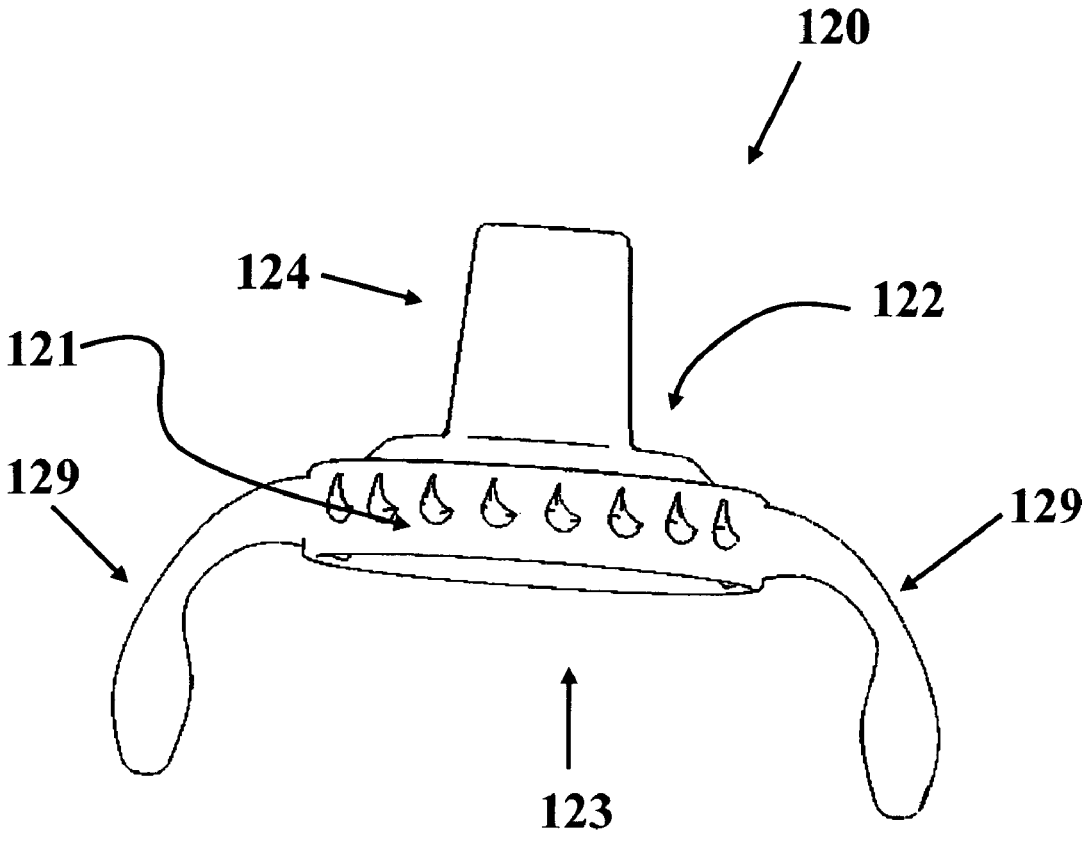
FIG. 8 representatively illustrates a plan view of the locking lid of the (non-disposable) reusable drinking device of FIG. 6.
Figure 9:
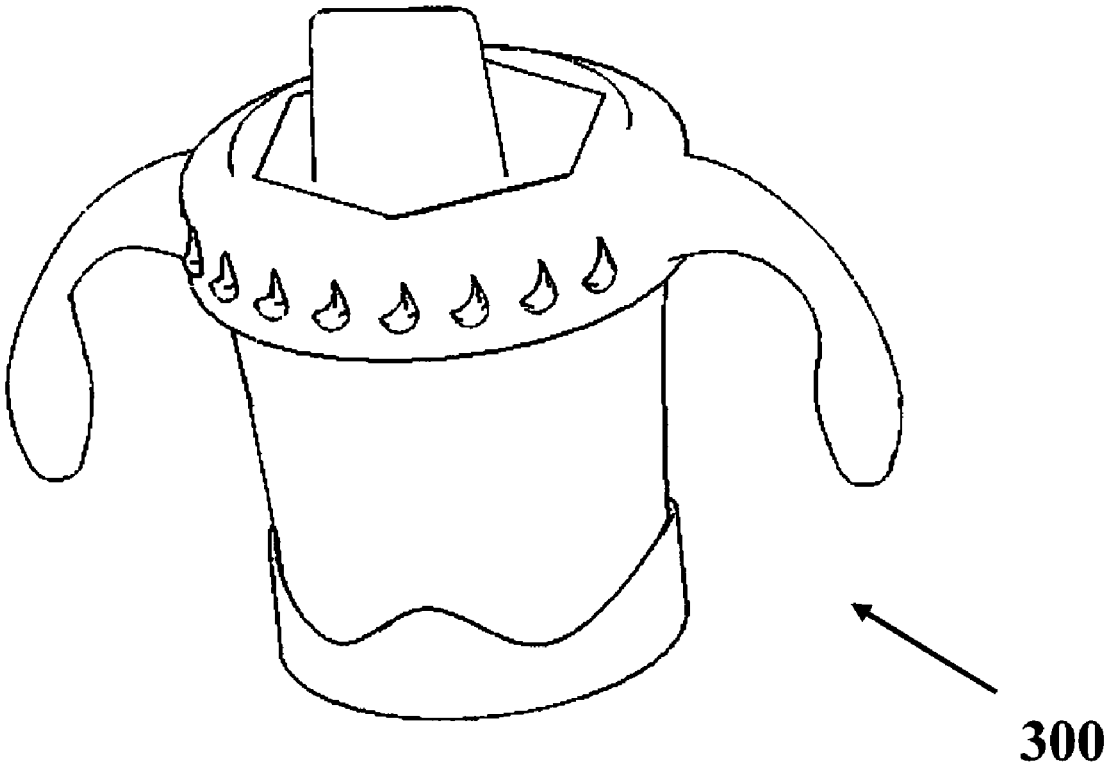
FIG. 9 representatively illustrates a plan view of the educational disposable drinking device containing a mechanical interlock mean between the lid and the locking ring.
Figure 10:
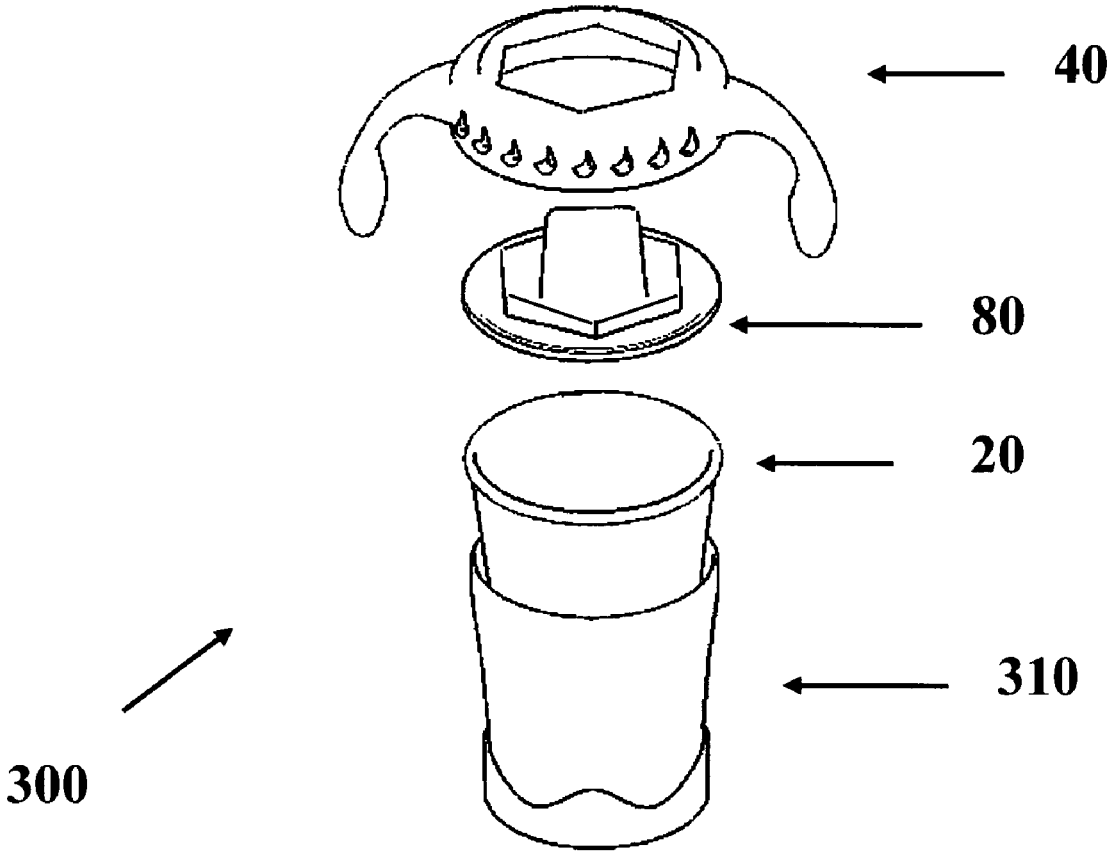
FIG. 10 representatively illustrates an exploded view of the educational disposable drinking device of FIG. 9.

The locking cap 120 shown in FIG. 8 is used to cover the opening end of the holder 310 and to provide a drinking spout to controllably release liquid to the user's mouth. The locking cap 120 can have a cylindrical shape, having a body 121, an opening end 123 and close end 122 with a drinking spout 124. The internal surface of the locking cap body 121 has threads (not shown) to sealably engaged with external threads 314 on the holder 310. Handles 129 are attached to the exterior surface of the locking cap body 121 to make it easy for the user to hold the sippy cup 400.

The user will be able to use the drinking device interchangeably either as the disposable sippy cup 300 or as the reusable sippy cup 400. This convertibility provides great convenience to the user. For example, when the user runs out of the disposable container 20 and/or the disposable lid 80 before her/his next shopping trip, the user can use the holder 310 with the locking cap 120 as a sippy cup. Thus, this convertibility provides un-interrupt usage of the drinking device for the user. So, in some embodiments the sippy cup comprises the holder and locking cap or lid without a disposable portion. In some embodiments, the holder has a surface with a plurality of symbols in a learning arrangement.

In at least one embodiment of the present invention, the educational disposable drinking device 300 contains a mechanical interlock means between the lid 80 and the locking ring 40 (Shown in FIG. 9, FIG. 10, FIG. 11 and FIG. 12). This mechanical interlock means ensures that the drinking spout 84 is centered between the two handles 401. This alignment between the drinking spout and the handles provides a more natural, comfortable way for the user to drink while holding the drinking device.

Figure 11:
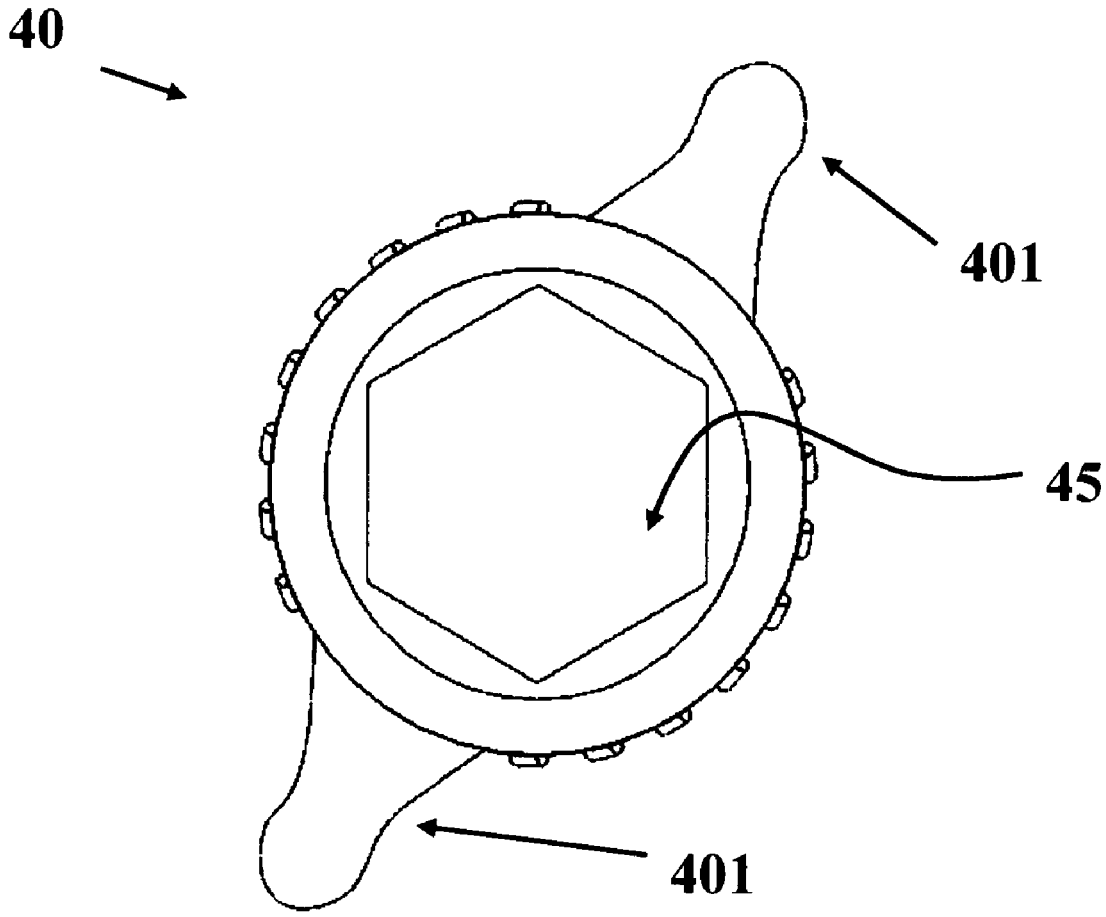
FIG. 11 representatively illustrates a top view of the locking ring of the educational disposable drinking device of FIG. 9.

The locking ring 40 shown in FIG. 11 has two handles 401 and a lid opening 45. The lid opening 45 has a hexagon shape to fit with the hexagon shaped portion of the disposable lid 80.

Figure 12:
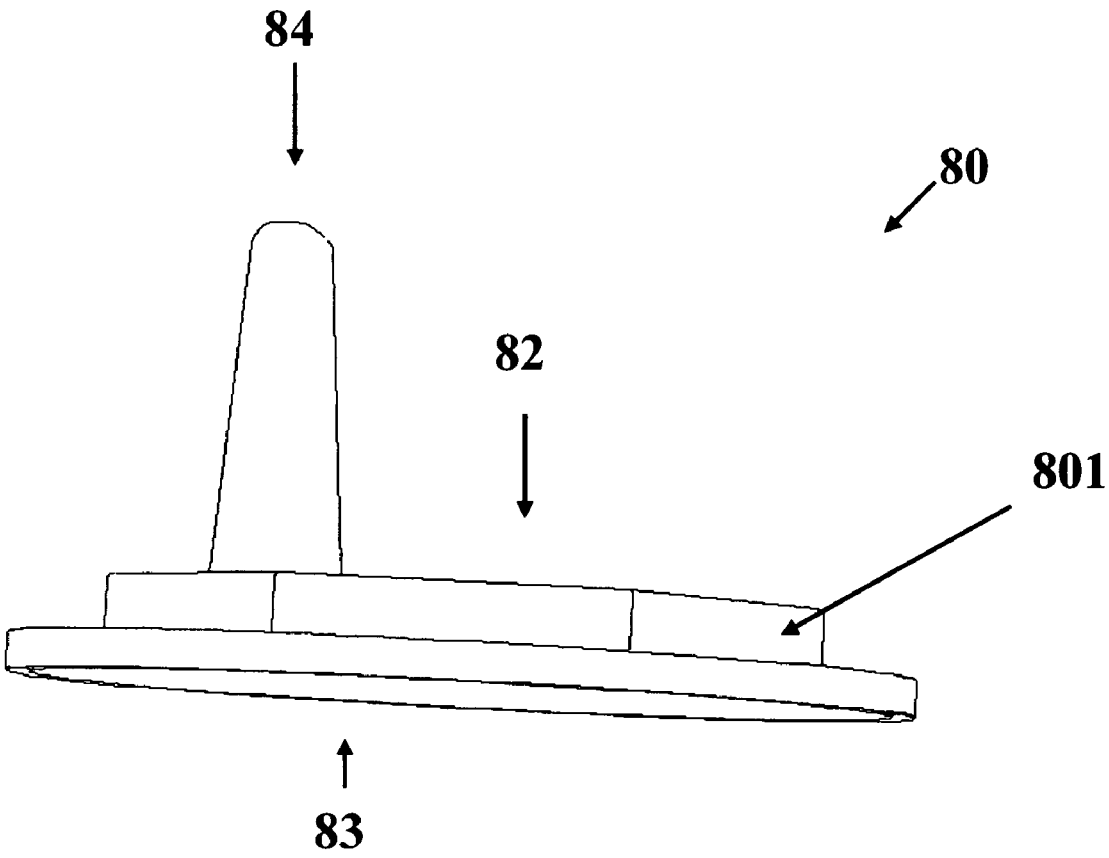
FIG. 12 representatively illustrates a side view of the lid of the educational disposable drinking device of FIG. 9.

The disposable lid 80 shown in FIG. 12 has an opening end 83, a close end 82 with a drinking spout 84 and a hexagon shape side wall 801. The hexagon shape side wall 801 has an outer dimension slightly smaller than the hexagon shape opening 45 of the locking ring 40.

When the drinking device 300 is assembled, the lid 80 is placed into the locking ring 40 with the drinking spout 84 centering between the handles 401. The engagement of the hexagon shape side wall 801 inside the hexagon shape opening 45 keeps the lid 80 fixed relative to the locking ring 40 as the locking ring 40 is rotated to engage onto the external threads 314 of the holder 310.

In at least one embodiment, any shapes other than a circular shape can be used for the side wall 801 and the lid opening 45 to keep the lid 80 in the right position with the locking ring 40.

In at least one embodiment of the present invention, a mechanical interlock mean between the lid 80 and the locking ring 40 is provided as shown in FIG. 13, FIG. 14 FIG. 15 and FIG. 16.

The locking ring 40 shown in FIG. 13 has two pins 402 protruded down a certain length from the interior surface of the end wall 42. The length of the pins 402 is defined as the normal distance from the interior surface of the end wall 42 to the tip of the pins. The pins 402 provides a mean to register the lid 80 in the right position as the locking ring 40 is rotated to tighten onto the holder 310.

The disposable lid 80 shown in FIG. 14 and FIG. 15 is provided with two channels 805. The width 806 of the channels 805 is wider than the width of the pins 402. The channels 805 are deep enough to receive the pins 402. In at least one embodiment, the channels 805 have a depth dimension of equal or larger than the length of the pins 402. In at least one embodiment, the pins 402 would fit inside the channels 805. As the locking ring 40 rotating in the clockwise direction 809 to tighten against the holder 310, the pins 402 decent into the channels 805. As the pins 402 reach the end of the channels 805, the pins 402 force the lid 80 to rotate with them. Thus, the pins 402 keep the lid 80 in a fixed position relative to the locking ring 40. The position of the pins 402 and the channel 805 can be made such that the drinking spout 84 is always centered between the handles 401 when the locking ring 40 is fully engaged to the holder 310.

The two channels 805 may be substantially symmetrical from one another. In at least one embodiment, the length of each channel is at least a quarter of the circumference of the circle that the pins 402 travel. The number of pins 402 and number of matching channels 805 is at least one, but in some embodiments is preferably 2, 3, or 4.

It is intended that all matter contained in the above description and shown in the accompanying drawings shall be interpreted as illustrative and not in a limiting sense.

What is claimed is:

1. An educational drinking device, comprising: (a) a disposable cylindrically shaped container, said container has an open container end and a closed container end, (b) a surface providing a plurality of different symbols in a learning arrangement extending about the circumference of the container the plurality being a grouping of related items, (c) a disposable lid, said lid engaging said open container end, the lid having a drinking spout extending from a base portion of the lid, (d) a cylindrically shaped holder and locking ring, the holder having an open end for receiving the container therein and for fastening to the locking ring, the locking ring having an ovening there through, at least a portion of the lid extending through the opening of the locking ring.

2. The educational drinking device of claim 1 wherein the plurality of symbols are arranged on the outside of said container.

3. An educational drinking device of claim 1 comprising: (a) a plurality of disposable cylindrically shaped containers, each container having an open container end and a closed container end, (b) each container having a surface providing a plurality of different symbols in a learning arrangement, the plurality of different symbols being a grouping of related items extending circumferentially about the container for at least 90 degrees, the plurality of disposable cylindrically shaped containers including containers having different groupings of related items, (c) at least one of the containers having different symbols than the rest.

4. The educational drinking device of claim 1, wherein the plurality of different symbols in the learning arrangement extending circumferentially about the container for at least 90 degrees.

5. The educational drinking device of claim 1, wherein said plurality of symbols are selected from the group consisting of letters of the alphabet, numbers, geometric shapes, and any combination thereof.

6. The educational drinking device of claim 1, wherein said symbols are selected from the group consisting of characters, concepts, pictures, words, images, and any combination thereof.

7. The educational drinking device of claim 1, wherein the holder comprises a transparent material extending about the circumference of the holder such that the plurality of symbols may be viewed through at least a portion of the holder.

8. The educational drinking device of claim 1, the disposable lid having a locking portion extending from the base portion, the locking portion having a shape that fittingly engages the opening of the locking ring such that the locking portion and the opening of the locking ring are in a substantially fixed circumferential position relative to one another when engaged.

9. The educational drinking device of claim 8 wherein the locking portion and the opening of the locking ring are non-circular shaped.

10. The educational drinking device of claim 8 wherein the locking ring further includes two handles, the handles disposed such that when the locking ring is fastened to the holder and engaged to the disposable lid, the drinking spout is substantially equidistant to each of the two handles.

11. The educational drinking device of claim 1, the disposable lid having at least one channel having a locking end, the locking ring having at least one protrusion extending into the at least one channel, circumferential movement of the locking ring relative to the holder engages the protrusion to the locking end of the channel thereby positioning the locking ring and the disposable lid into a substantially fixed circumferential position relative to one another while being fastened to the holder.

12. The educational drinking device of claim 11 wherein the locking ring further includes two handles, the handles disposed such that when the locking ring is fastened to the holder and engaged to the disposable lid, the drinking spout is substantially equidistant to each of the two handles.

13. The educational drinking device of claim 1 wherein the plurality of symbols is at least one progression or sequence of alphanumeric characters.

14. An educational drinking device, comprising: (a) a disposable cylindrically shaped container, said container having an open container end and a closed container end with sides there between, (b) a disposable lid engaging said open container end, the lid having a drinking spout extending from a base portion of the lid, (c) a cylindrically shaped holder and locking ring, the holder having an open end for receiving the container therein and for fastening to the locking ring, the locking ring having an opening there through, at least a portion of the lid extending through the opening of the locking ring, and (d) a surface of the container with a plurality of symbols in a learning arrangement viewable through the holder.

15. The educational drinking device of claim 14 further comprising a locking lid, the holder being capable of sealably fastening to the locking lid having a drinking spout extending from a base portion of the locking lid, in a reusable configuration the locking lid fastens to the holder to form a substantially water-tight seal, in a disposable configuration the disposable container is disposed within the holder and the locking ring having the disposable lid extending thought the opening of the locking ring fastens to the holder to form a substantially water-tight seal between the lid and the container.

16. The educational drinking device of claim 14 wherein the container includes a sheet disposed about the sides, the sheet having a surface with a plurality of symbols in a learning arrangement viewable through the holder.

17. The educational drinking device of claim 14 wherein the disposable lid having a locking portion extending from the base portion, the locking portion having a shape that fittingly engages the opening of the locking ring such that the locking portion and the opening of the locking ring are in a substantially fixed circumferential position relative to one another when engaged.

18. The educational drinking device of claim 14 having a locking portion extending from the base portion of the disposable lid, wherein the locking portion and the opening of the locking ring are non-circular, and the locking ring further includes two handles, the handles disposed such that when the locking ring is fastened to the holder and engaged to the disposable lid, the drinking spout is substantially equidistant to each of the two handles.

* * * * *